United States Patent [19]

Griffin et al.

[11] 4,296,611

[45] Oct. 27, 1981

[54] HOUSEHOLD REFRIGERATOR AIR FLOW CONTROL AND METHOD

[75] Inventors: James R. Griffin; Raymond M. Schreck, both of Louisville, Ky.

[73] Assignee: General Electric Company, Louisville, Ky.

[21] Appl. No.: 133,209

[22] Filed: Mar. 24, 1980

Related U.S. Application Data

[62] Division of Ser. No. 967,743, Dec. 8, 1978, Pat. No. 4,229,945.

[51] Int. Cl.[3] ..... F25D 17/06

[52] U.S. Cl. ..... 62/89; 62/408

[58] Field of Search ..... 62/89, 186, 187, 229, 62/408, 443, 445; 236/99 D, 49

[56] References Cited

U.S. PATENT DOCUMENTS

| | | | |
|---|---|---|---|
| 2,241,108 | 5/1941 | Akers | 236/49 |
| 3,093,981 | 6/1963 | O'Grady | 62/408 |
| 3,107,502 | 10/1963 | Herndon, Jr. et al. | 62/180 |
| 3,320,761 | 5/1967 | Gelbard | 62/180 |
| 3,364,694 | 1/1968 | Cohen et al. | 62/265 |
| 3,403,533 | 10/1968 | Bollenbacher | 62/408 |
| 4,009,589 | 3/1977 | Webb et al. | 62/180 |
| 4,122,687 | 10/1978 | McKee | 62/156 |

*Primary Examiner*—William E. Tapolcai, Jr.
*Attorney, Agent, or Firm*—Frederick P. Weidner; Radford M. Reams

[57] ABSTRACT

A refrigerator having a freezer compartment on top and a fresh food compartment below with an air duct connecting the two compartments. A temperature control system and method of controlling is provided and includes a temperature sensing element located at the top of the fresh food compartment and shielded from the stream of cold air being directed into the fresh food compartment. The temperature sensing element changes the temperature in both the freezer and fresh food compartments without changing the constant ratio of those respective compartment temperatures. An air flow assembly divides the cold air entering the fresh food compartment through the connecting air duct between the top of the compartment and the bottom. The air flow control assembly is arranged to divide the cold air stream such that the ratio of the difference in the freezer and fresh food compartment temperatures is changed. By this air flow system and method, the interaction between the cold air flow control and the temperature sensing element provides that the temperature in the freezer compartment may be adjusted up or down while the fresh food compartment temperature remains relatively constant.

7 Claims, 3 Drawing Figures

HOUSEHOLD REFRIGERATOR AIR FLOW CONTROL AND METHOD

CROSS REFERENCE TO RELATED APPLICATION

This application is a division of copending Pat. Application Ser. No. 967,743, filed Dec. 8, 1978, now U.S. Pat. No. 4,229,945, for "Household Refrigerator Air Flow Control and Method" in the names of James R. Griffin and Raymond M. Schreck and assigned to the assignee of this application.

BACKGROUND OF THE INVENTION

This invention relates to household refrigerators and is more particularly concerned with a combination refrigerator, that is, a refrigerator including a freezer compartment on top and a fresh food compartment below, both of which are cooled by circulation air from the two compartments over a single evaporator employing a single fan to accomplish the circulation. This invention relates to an air flow control and method of controlling the circulation of air to thus control the temperature of the refrigerator compartments.

Combination refrigerators, including a single evaporator and a single fan for circulating air from the freezer and fresh food compartments over the evaporator are well known. In the operation of such refrigerators, a major portion of the refrigerated air from the evaporator is directed into the freezer compartment while a smaller portion is directed into the fresh food compartment. In addition to the cost advantage resulting from the employment of a single evaporator and a single fan for refrigerating two separate compartments, such refrigerators have the additional advantage of permitting automatic defrost of the evaporator which is normally contained within an evaporator chamber outside of or separate from both of the storage compartments without significantly disturbing the temperatures of those compartments.

Various means have been used or proposed for providing temperature control employing a single thermostat for maintaining the two compartments within their desired operating temperature ranges. One such means of control is described in U.S. Pat. No. 3,320,761. Generally, thermostatic control of the evaporator is achieved by using an air temperature sensing element in the warmer fresh food compartment. An adjustable air flow divider proportions the flow of air cooled by the evaporator, through the freezer and fresh food compartments, to thus provide the desired temperature differential between the freezer and fresh food compartments.

The air flow divider is adjusted, however, during a particular ambient atmospheric condition, for example, 70° F., the satisfactory control may not be achieved at a higher ambient atmospheric temperature, for example, 100° F., due to the unequal rate of heat flow into the fresh food compartment. In the higher ambient temperatures, the heat flow from the ambient into the fresh food compartment is higher relative to the freezer compartment than in low ambient temperatures. This can be remedied by increasing the ratio of cold air into the food storage compartment in higher ambients. Such changes in usage conditions may be accommodated by including a manually-operable fresh food compartment air flow adjustment. One such control system is shown in U.S. Pat. No. 3,656,314 wherein there is described an air conduit having branches that provide separate cooling air discharge into the freezer compartment and has a temperature sensing means disposed in the conduit for controlling the temperature. The temperature sensing means, however, is located in the cold air stream upstream of a damper that controls the amount of cold air being introduced into the fresh food compartment. With this arrangement, the temperature sensing means will give a constant freezer control response rather than a constant fresh food response since it is most heavily biased by freezer air temperature. There is an adjustable control for regulating the amount of cold air passing into the fresh food compartment. However, with such an arrangement, the fresh food temperature is inadvertently affected which can result in the temperature being either too high or too low in the fresh food compartment.

It is highly desirable to control the temperature in the refrigerator so that the temperature in the fresh food compartment stays relatively constant and the ratio of the temperatures in the freezer and fresh food compartments is changed. By our invention, these desirable characteristics of a refrigerator air flow system are provided.

SUMMARY OF THE INVENTION

There is provided in a refrigerator having a freezer compartment on top and a fresh food compartment below the freezer compartment an air flow system including an air duct connecting the freezer compartment and the fresh food compartment to introduce a stream of cold air into the fresh food compartment. There is a temperature sensing element located at the top of the fresh food compartment and shielded from the stream of cold air being directed into the fresh food compartment. This temperature sensing element is utilized to change the temperature in both the freezer and fresh food compartments without significantly changing the constant ratio of those respective compartment temperatures. This may be accomplished by turning the refrigeration system and fan on and off in response to a present temperature calibration of the temperature sensing element, thereby controlling the total quantity of cold air being made available to the freezer and fresh food compartments. An air flow control assembly is located in the cold air stream and is utilized to divide the cold air entering the fresh food compartment between the top of the compartment and the bottom. The air flow control assembly includes a chamber for receiving the stream of cold air and a first opening for directing a portion of the stream of cold air into the top of the fresh food compartment with a first air passage from the chamber to the first opening. There is also a second opening for directing a portion of the stream of cold air downwardly into the bottom of the fresh food compartment and a second air passage from the chamber to the second opening. The assembly has first and second dampers and means for rotating the dampers in unison with the dampers being spaced from each other such that when the first damper blocks the first air passage, the second damper blocks the second air passage. Upon rotation of the dampers, they will divide the cold air stream being directed to the first and second openings and change the ratio of the temperature in the freezer and fresh food compartments. By so doing, the interaction between the air flow system and the temperature sensing element allows the temperature in the freezer compartment to be adjusted up or down while the fresh food temperature remains relatively constant.

DESCRIPTION OF THE PREFERRED EMBODIMENT

Figure 1:
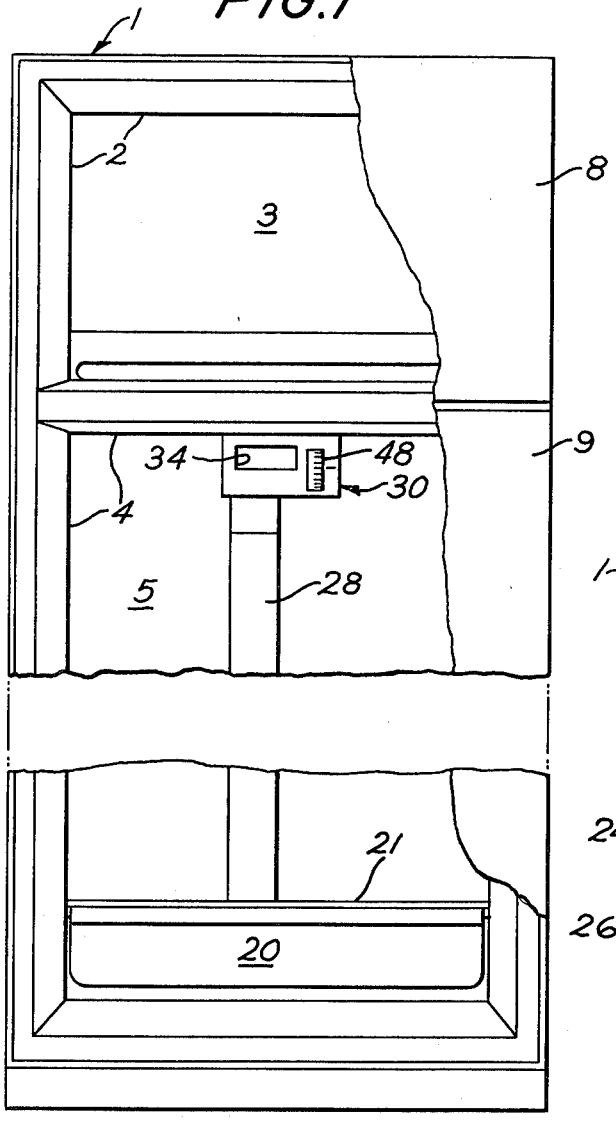
FIG. 1 is a front elevational view of a refrigerator having a freezer compartment on top and a fresh food compartment on the bottom embodying the invention.
Figure 2:
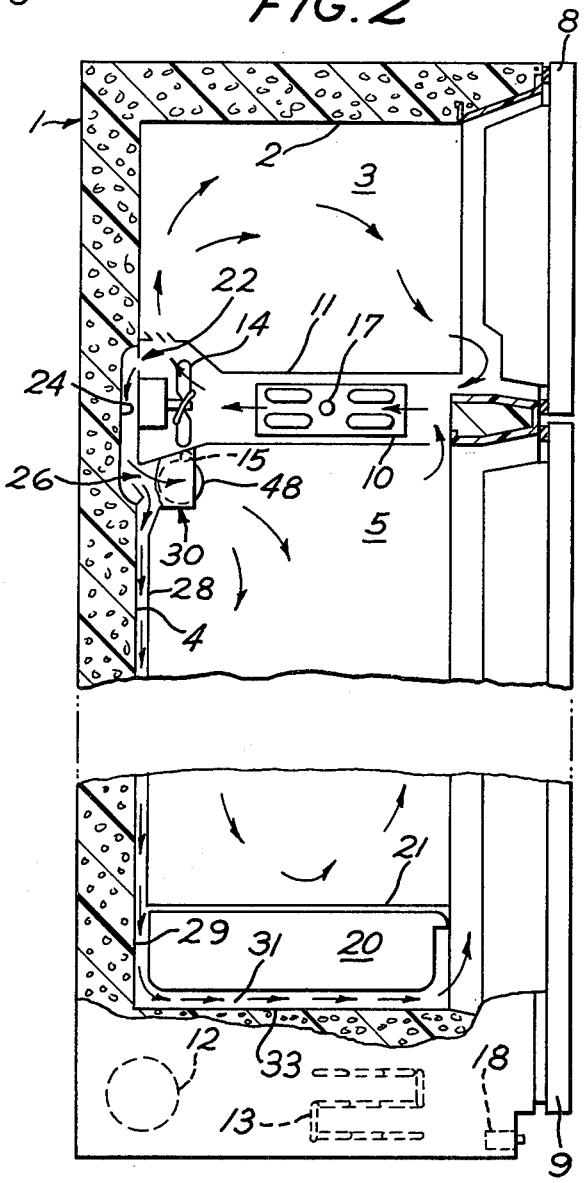
FIG. 2 is a side elevational view, partly in section, of a refrigerator cabinet having a freezer compartment on top and a fresh food compartment on the bottom showing somewhat schematically one form of the present invention as embodied herein.

With reference to FIGS. 1 and 2 of the drawings, there is illustrated a refrigerator cabinet including an outer case 1, an upper inner liner 2 defining a freezer storage compartment 3 and a lower inner liner 4 defining a fresh food storage compartment 5. The forward edges of both liners are spaced from the forward edges of the case 1 and these spaces are bridged by heat insulating breaker strips 6 while the spaces between the liners and the outside case are filled with suitable insulating material 7. The access openings to the freezer and fresh food compartments are respectively closed by doors 8 and 9.

Refrigeration for the two compartments is provided by an evaporator 10 positioned in the partition 11 between the two liners 2 and 4 which form part of the refrigeration system including compressor 12 and a condenser 13. A fan 14 rearwardly from the evaporator 10 provides means for circulating air from the two compartments over the evaporator 10 and back into the compartments.

A temperature control thermostat generally indicated by the numeral 15, including a temperature sensing element 16 (FIG. 3), is provided for automatically controlling the operation of the compressor 12 to maintain the temperature within the fresh food compartment within a controlled range. This thermostat and its cooperation with the other components of the air flow control system will be discussed in more detail later.

The evaporator 10 operates at temperatures below freezing and, for the purpose of periodically removing accumulated frost from the evaporator surfaces, there is provided a defrost heater 17 which is periodically energized by operation of a timer 18.

The refrigerator thus far described is similar to that shown and described in U.S. Pat. No. 3,320,761, assigned to the same assignee as the present invention, and reference is made to that patent for a more complete description of the operating components thereof.

In household refrigerators it is often desirable to provide a pan in the fresh food compartment in which fresh meat and the like may be kept and usually at a slightly lower temperature than the rest of the fresh food compartment. As shown in FIGS. 1 and 2, there is a meat keeper pan 20 located at the bottom of the fresh food compartment 5. The meat keeper pan 20 includes a cover 21 to prevent any circulation of air within the fresh food compartment 5 from tending to dry out the food items maintained in the meat keeper pan 20.

With reference to FIG. 2 in the operation of the refrigerator, the fan 14 operates to pull air across the cold evaporator 10 which air enters the partition 11 upstream of the evaporator 10 from both the freezer compartment 3 and the fresh food compartment 5, as shown by the arrows. The air which is cooled by passing over the evaporator 10 is fan forced into the freezer compartment 3. The rear of the freezer compartment has an opening 22 that allows some of the cold air to flow into an air duct 24 connecting the freezer compartment and fresh food compartment. The air duct 24 has a discharge opening 26 for introducing cold air into the fresh food compartment 5. By our invention, the cold air stream being discharged into the fresh food compartment 5 is divided so that a portion of the cold air stream is directed to the top of the fresh food compartment and a portion is directed downwardly to the bottom of the fresh food compartment and preferably to an area surrounding the meat keeper pan 20 since it is desirable that that pan and its contents be kept at a slightly lower temperature than the rest of the fresh food compartment. The downwardly directed air flows in an air duct 28 from the top of the fresh food compartment to the bottom. The meat keeper pan 20 is spaced slightly forwardly of wall 29 that forms a part of air duct 28 so that a variable cross-section passageway 31 is provided between the rear wall 29 and it and between the bottom wall 33 and it to lead the flow of air from the air duct 28 downwardly around and then forwardly around the meat keeper pan 20 then upwardly within the fresh food compartment 5. By this direct impingement of cold air on the meat keeper pan 20, the temperature of the meat keeper is maintained at a slightly lower temperature than the remainder of the fresh food compartment 5. To divide the stream of cold air being directed into the fresh food compartment, as described above, there is provided an air flow control assembly 30, the operation and function of which will now be described.

Figure 3:
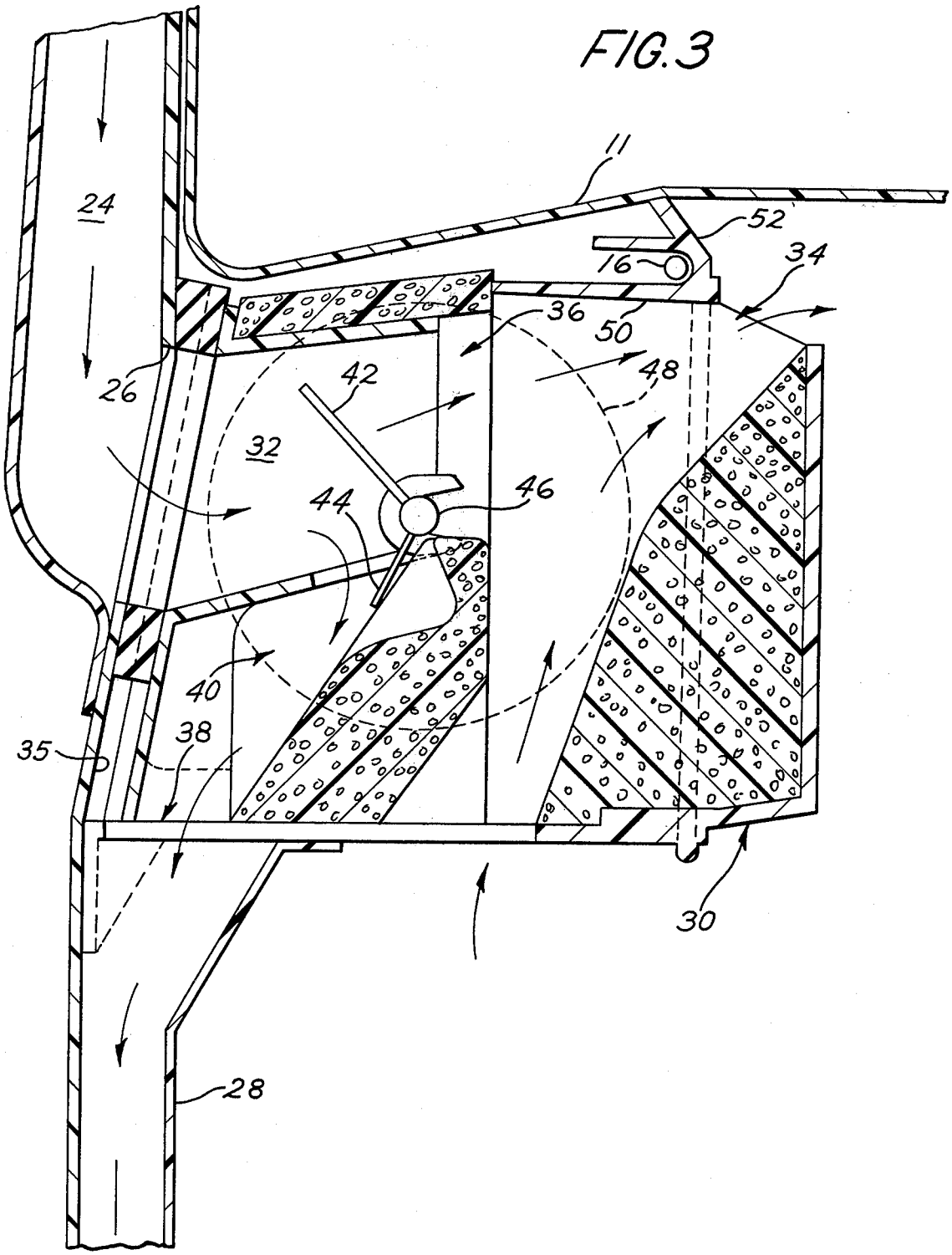
FIG. 3 is a cross sectional view of the air flow control assembly of the present invention.

With reference to FIG. 3, the air flow control assembly 30 is shown in cross sectional detail and it is positioned within the fresh food compartment 5 in close proximity to the partition 11 dividing the freezer and fresh food compartments 3 and 5 respectively. The air flow control assembly 30 is secured by any suitable means to the partition 11 and the rear wall 35 of the lower inner liner 4. The cold air passing downwardly through air duct 24 enters the air flow control assembly 30 through opening 26 into an air chamber 32. The air flow control assembly 30 has a first opening 34 for directing a portion of the stream of cold air into the top of the fresh food compartment. There is a first air passage 36 from the chamber 32 to the first opening 34. The air flow control assembly 30 also includes a second opening 38 for directing a portion of the stream of cold air downwardly into the bottom of the fresh food compartment and a second air passage 40 from the chamber 32 to the second opening 38. The second opening 38 discharges air into the air duct 28 which leads to the bottom of the fresh food compartment 5 and particularly to the meat keeper pan 20.

To control the amount of cold air being divided between the first opening and second opening respectively, there is provided in the air flow control assembly an air flow control having a first damper 42 and a second damper 44 attached to a rotatable axle 46. The dampers 42 and 44 are spaced from each other and are stationarily fixed to the axle 46 such that when the first damper 42 blocks the first air passage 36, the second damper 44 is in position to block the second air passage 40. At one end of the axle 46, there is a dial 48 accessible from the interior of the fresh food compartment 5 to allow an operator to manually rotate the dial which, in turn, rotates the axle and the attached dampers. By such manual rotation, the amount of air being directed through the respective first and second openings 36 and 38 may be easily controlled. In effect, then, the air flow control operates as a metering device to adjust the amount of cold air being directed to the top of the fresh food compartment and to the bottom of the fresh food compartment. The first opening 34 and passage 36 are larger in dimension than the second opening 38 and passage 40 so that a larger amount of the cold air will be discharged into the top of the fresh food compartment relative to the cold air being discharged into the bottom of the fresh food compartment. Generally speaking, the amount of total cold air being discharged through the first opening 34 is approximately two times the amount of cold air being discharged through the second opening 38.

As mentioned previously, there is provided a thermostat 15 having a temperature sensing element 16 for controlling the temperature of the refrigerator. The temperature sensing element 16 is located above the air flow control assembly 30 and is shielded from the stream of cold air passage through the first passage 36 and the opening 34. This shielding is provided by the upper wall 50 of a portion of the first passage 36 and an upwardly projecting wall 52 between the upper wall 50 and the partition 11. Operation of the refrigerating system, including the fan, causes air from both the freezer compartment 3 and the fresh food compartment 5 to pass over the cold evaporator 10 and be introduced into the freezer compartment 3. From the freezer compartment 3, a stream of cold air is caused to flow into the fresh food compartment 5. The method of controlling the refrigerator temperature includes locating the temperature sensing element 16 at the top of the fresh food compartment 5 and shielding the temperature sensing element from the stream of cold air being directed into the fresh food compartment. This arrangement allows the thermostat to sense the temperature of a mixture of the fresh food compartment ambient temperature and the temperature of the cold air flowing through the air flow control assembly, and is most heavily biased by the fresh food compartment temperature. The temperature sensing element is utilized to control the temperature in both the freezer and fresh food compartment without significantly changing the constant ratio of the respective compartment temperatures. That is, by locating the temperature sensing element at the top of the fresh food compartment and shielded from the flow of cold air being introduced in the fresh food compartment, it will act to control the temperature of the freezer by controlling the amount of cold air supplied to the freezer, but will not affect the ratio of the temperature in the freezer compartment relative to the temperature in the fresh food compartment. By our method of controlling the temperature of the refrigerator, the stream of cold air entering the fresh food compartment is divided into two streams, one going to the top of the fresh food compartment—the other going to the bottom of the fresh food compartment. The control provides for an equal ratio of the amount of air flowing in the two streams. That is, if the dial 48 is manually rotated which moves damper 42 to reduce the amount of cold air from the chamber 32 through passage 36 and first opening 34, the amount of cold air flowing from the chamber 32 through passage 40 and second opening 38 will also be proportionally reduced. Conversely, by moving the dial 48 in the opposite direction, the amount of cold air passing from the chamber 32 through passage 36 and the first opening 34 is increased and the amount of cold air passing from the chamber 32 through passage 40 and the second opening 38 will be proportionally increased. The cooperation or interaction between the temperature sensing element 16 and its shielding structural arrangement, together with the proportionate control of the stream of cold air being directed to the top and to the bottom of the fresh food compartment, will cause the temperature in the freezer compartment to be either raised or lowered and the temperature difference between the fresh food compartment temperature and the freezer temperature will be changed so that the fresh food compartment temperature remains relatively constant.

The foregoing is a description of the preferred embodiment and method of the invention and it should be understood that variations may be made thereto without departing from the true spirit of the invention as defined in the appended claims.

What is claimed is:

1. The method of controlling the temperature in a refrigerator having a freezer compartment and a fresh food compartment separated by a partition comprising:

(a) flowing a stream of cold air into the fresh food compartment, (b) locating a temperature sensing element at the top of the fresh food compartment, (c) shielding the temperature sensing element from the stream of cold air being directed into the fresh food compartment, (d) controlling the temperature in both the freezer and fresh food compartments without significantly changing the constant ratio of those respective compartment temperatures by utilizing the temperature sensing element, (e) dividing the stream of cold air entering the fresh food compartment into two streams, one going to the top of the fresh food compartment, and the other going to the bottom of the fresh food compartment, and (f) controlling in equal ratio the amount of air flowing in the two streams to thereby change the ratio of the temperatures in the freezer and fresh food compartments.

2. The method of claim 1 wherein the ratio of the cold air stream going to the top of the fresh food compartment relative to the stream going to the bottom of the fresh food compartment is approximately two to one.

3. The method of claim 1 wherein the stream of cold air going to the bottom of the fresh food compartment is impinged upon a meat keeper pan.

4. The method of claim 1 wherein the freezer compartment is on top and the fresh food compartment is below the freezer compartment.

5. The method of claim 1 wherein controlling in equal ratio the amount of air flowing in the two streams is by rotating dampers to cause the air flowing in both streams to be increased and decreased in equal ratio.

6. The method, according to claim 5, wherein the dampers are fixed to a rotatable axle and the rotating is accomplished manually.

7. The method, according to claim 6, wherein moving a dial accessible from inside the fresh food compartment and connected to the axle is utilized for rotating the dampers.

* * * * *